US007574833B2

(12) United States Patent
Stark

(10) Patent No.: US 7,574,833 B2
(45) Date of Patent: Aug. 18, 2009

(54) ACOUSTIC DEVICE FOR USE ON OFFICE PARTITIONS

(75) Inventor: Charles H. Stark, 6537 Wayne Ct., Maumee, OH (US) 43537

(73) Assignee: Charles H. Stark, Maumee, OH (US)

( * ) Notice: Subject to any disclaimer, the term of this patent is extended or adjusted under 35 U.S.C. 154(b) by 0 days.

(21) Appl. No.: 11/711,296

(22) Filed: Feb. 28, 2007

(65) Prior Publication Data

US 2007/0204529 A1 Sep. 6, 2007

Related U.S. Application Data

(60) Provisional application No. 60/777,885, filed on Mar. 1, 2006.

(51) Int. Cl.
*E04B 1/82* (2006.01)

(52) U.S. Cl. ..... 52/144; 52/145; 181/295

(58) Field of Classification Search ..... 52/144, 52/145, 287.1, 288.1, 36.1, 239, 243.1; 181/210, 181/295, 30, 284, 287, 290, 294, 293; 160/135, 160/351

See application file for complete search history.

(56) References Cited

U.S. PATENT DOCUMENTS

| | | | | |
|---|---|---|---|---|
| 3,592,289 | A * | 7/1971 | Aysta et al. | 160/135 |
| 4,548,292 | A * | 10/1985 | Noxon | 181/295 |
| 4,750,586 | A * | 6/1988 | Lerner et al. | 181/295 |
| 5,035,298 | A * | 7/1991 | Noxon | 181/295 |
| 5,521,338 | A * | 5/1996 | Shono et al. | 181/210 |
| 6,810,991 | B1 * | 11/2004 | Suzuki | 181/210 |
| 7,178,630 | B1 * | 2/2007 | Perdue | 181/290 |
| 2003/0019170 | A1 * | 1/2003 | Donnelly | 52/144 |

* cited by examiner

*Primary Examiner*—Richard E Chilcot, Jr.
*Assistant Examiner*—Mark R Wendell
(74) *Attorney, Agent, or Firm*—Emch, Schaffer, Schaub & Porcello, Co., L.P.A.

(57) ABSTRACT

This invention is a device that is mounted on the top of a movable office partition to improve the acoustical efficacy of the partition. It is equally effective on new or on existing partitions and can be made to fit all the major brands in the movable partition market. It is attractive, lightweight, durable, inexpensive to manufacture and easy to install. The device is able to absorb incident sound and redirect diffracted sound to a path that will reduce sound levels reaching a listener in adjacent cubicles.

7 Claims, 2 Drawing Sheets

ACOUSTIC DEVICE FOR USE ON OFFICE PARTITIONS

CROSS REFERENCE TO RELATED APPLICATIONS

This application claims the benefit of U.S. provisional patent application Ser. No. 60/777,885 filed Mar. 1, 2006.

BACKGROUND OF THE INVENTION

Low, movable partitions have become the standard method of providing individual space cubicles for millions of office workers throughout the world. The principal deficiency with all low participation systems is the lack of acoustical privacy. If a worker in a cubicle is able to hear what is said in the next cubicle, it may be hard to concentrate and result in the loss of efficiency and productivity. This invention consists of a sound diffraction device to be installed on the top of movable office partitions. The addition of this invention improves the acoustical performance of movable office partitions.

SUMMARY OF THE INVENTION

This invention consists of a device that is mounted on the top of a movable office partition to improve the acoustical efficacy of the partition. It is equally effective on new or on existing partitions and can be made to fit all the major brands in the movable partition market; It is attractive, lightweight, durable, inexpensive to manufacture and easy to install. The device is able to absorb incident sound and redirect diffracted sound to a path that will reduce sound levels reaching a listener in he next cubicle.

Existing movable office partitions usually consist of two 1" thick fiberglass or other acoustically absorbent mats mounted on either side of a thin, rigid panel called a septum. The fiberglass is in the range of 3 to 6 pounds per cubic foot in density which is considerably greater than that used for thermal insulation. The edges of the fiberglass can be hardened if they are to be exposed, but this changes the acoustical absorbency; the broad exposed sides of the partition are usually covered with an acoustically transparent woven nylon fabric, sometimes with a backing sheet. Exposed and abutting edges (framework) of the partitions are usually made from a lightweight metal, wood or plastic. This exposed framework is a source of diffracted and reflected sound. The panels are joined by various interlocking devices. Almost all of the panels have one thing in common; they are modular, i.e. they are designed to be placed on centers that are measured in even whole numbers, with the exception of 18" panels. The sizes generally run from 1'-0" in width to 5'-0" in width. The heights vary but 5'-0" is probably the most common and is used as the basis for the examples of the effectiveness of this invention. A partition must be higher than both the source and the listener for the invention to make a significant improvement in the abatement of sound intrusion.

The diffraction abatement invention would be made in increments that coincide with the widths of the partitions. It would match or contrast with the office partitions depending on the buyer's choice. It would be made to clip over the top of the partitions and could easily be removed and reinstalled when the partitions are changed. The invention consists of a plastic, lightweight metal or fiberglass pipe core with an 8"+ or – diameter, which will act as a septum. Alternative core materials could be substituted provided they are rigid and dense. Attached to the bottom of the pipe core is a shallow legged inverted channel that will provide a solid, flat attachment surface. Fastened to the pipe channel with adhesive, rivets or screws is another channel designed to clip over the top of any manufacturer's movable partition. It would have a spring action and small inward curves in each leg of the channel to grip the partition's top frame. This makes it easy to attach and remove the device without tools. There are many other attachment methods and this detail is not germane to the acoustic results which constitute the basis of this patent application.

The core is wrapped with a fiberglass or other similar absorbent material. The absorbent material should consist of two or more layers of varying densities and thickness to create the most effective absorption coefficient. An example of a good combination is an outer layer of ⅛", thick fiberglass having a density of 6 pounds per cubic foot covering a 1", thick layer of fiberglass having a density of 3 pounds per cubic foot over a ⅞", thick layer of fiberglass having a density of 4 pounds per cubic foot. The overall diameter would then be 1"-0" (4" of absorbent material and an 8" core.) This is about the ideal diameter because it would absorb and refract sound frequencies above 1000 Hz and diffract sound frequencies below 1000 Hz. Larger sizes would be acoustically slightly more effective, but would be less stable and intrude into the space of a cubicle. Smaller sizes would be acoustically less functional.

The surface material would consist of an acoustically transparent woven fabric. Materials are available from various manufacturers that provide the correct acoustical properties, do not sag or "puddle," are durable, have a low cost and come in many colors. These are the ideal characteristics for the covering of the diffraction abatement invention because they would match the companion partitions in color and texture.

The fabric should be adhered to a thin acoustical fiberglass backing to provide stability and a surface upon which to glue the fabric to the fiberglass sound absorbent material. An acceptable alternate method of attachment is to tightly wrap the fabric around the sound absorbent material and staple or otherwise mechanically attach it. In either case the fabric would be cut to fit and folded over the ends of the sound absorbent material and attached thereto with glue.

The ends of the device would be covered by a thin metal, fiberglass or plastic disk. The disk would be attached to the ends of the pipe septum by countersunk screws. The ends of the septum/pipe would have a glued or otherwise attached plug to create a surface for attachment of the end cover disk. This end treatment would abut the next device and be exposed where partitions end, such as at the entrance to cubicles.

A corner sound abatement device of similar design is optional at the manufacturer's judgment. The corners would be of the same construction as the linear devices, but would have 45 degree ends cemented together to form a 90 degree corner. The acoustic benefits would be the same.

DETAILED DESCRIPTION OF THE PREFERRED EMBODIMENT(S)

Figure 1:
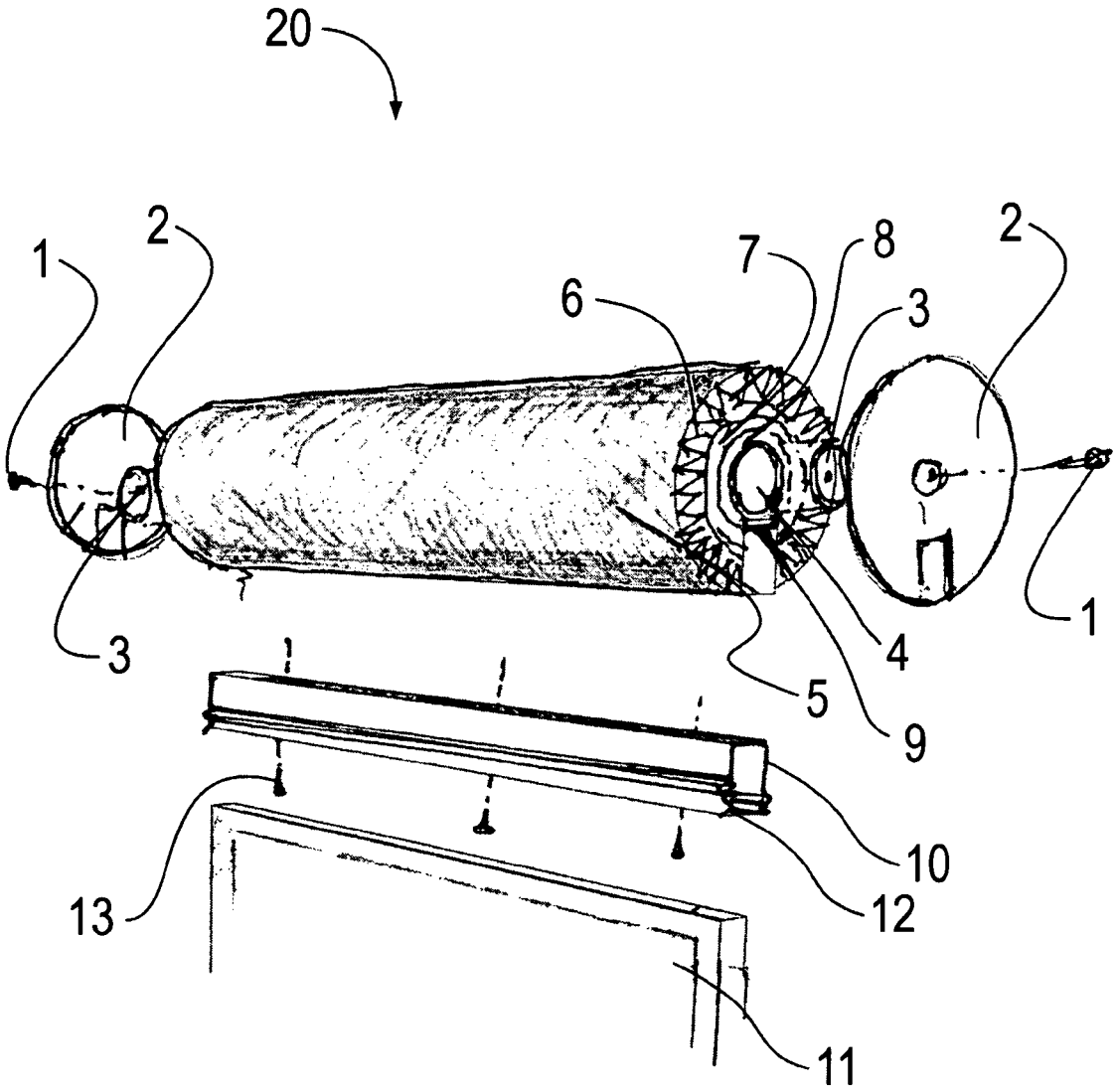
FIG. 1 shows the sound abatement device, its components and how it mounts on an office partition.

FIG. 1 is an exploded view showing the components and construction of the sound abatement acoustic device 20. The structural core or septum of the device consists of a length of 8" diameter pipe 4 which may be plastic, fiberglass or lightweight metal. Attached to the bottom of the core 4 is a core channel 9 that provides a flat mounting surface for the mounting channel 10. Fastened to core channel 9 with adhesive, rivets, or screws 13 is mounting channel 10. Mounting channel 10 is bent with small inward curves at the bottom of each leg 12 which provide a spring action. Wrapped around the pipe core 4 is ⅞" thick 6# an inner layer 8 of fiberglass having a thickness from about ½" to about 1" and a density from about 2 to about 8 pounds per cubic foot. In practice it has been found that an inner layer 8 having a thickness of ⅞" and a density of 6 pounds per cubic foot works particularly well. There is a gap in the inner layer 8 so that the mounting channel 10 is exposed. Wrapped around the inner layer 8 and the core 4 is a center layer 7 fiberglass with a bottom gap as on the previous layer. The center layer 7 of the sound absorbing fiberglass material has a thickness from about ½" to about 1½" and a density from about 1 to about 4 pounds per cubic foot. In practice it has been found preferable for the center layer 7 to have a thickness of 1" and a density of 3 pounds per cubic foot. An outer layer 6 of fiberglass is wrapped around the center layer 7 also with a bottom gap as in the inner and center layers. The outer layer 6 of sound absorbing fiberglass material has a thickness from about 1/16" to about ⅛" and a density from about 2 to about 8 pounds per cubic foot. In practice it has been found preferable for the outer layer 6 to have a thickness of ⅛" and a density of 6 pounds per cubic foot. It has also been found to be preferable if the inner, center and outer layer of sound absorbing material have a density that is different than the density of the sound absorbing material in the adjacent layer. The change in density provides an additional barrier to the transfer of sound waves and therefore sound through the acoustic device 20. The outer layer 6 is then wrapped with an acoustically transparent fabric 5 which may be glued or stapled to the outer layer 6. The bottom gap in the layers of fiberglass leave an opening for the mounting channel 10. A plastic plug 3 is cemented into both ends of the pipe 4 and an end cover disc 2 is attached to each end of the assembly 20 and is screwed into plug 3 with screw 1. The entire assembly 20 fits over an office partition 11 by sliding the open mounting channel 10 over the top of the partition. The spring action of mounting channel 10 clips over the top of the partition 11. In most application no fasteners are needed to secure the assembly 20 to the partition 11.

Figure 2:
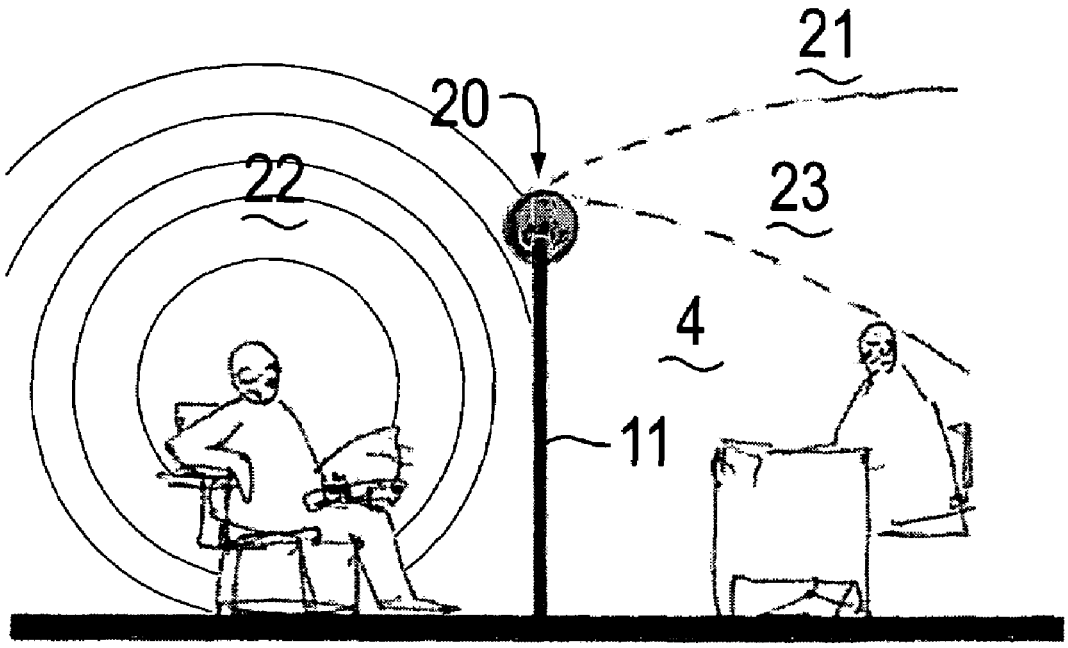
FIG. 2 shows how sound waves travel in a typical office setting and how the sound waves are modified with the sound abatement device.

FIG. 2 shows how the invention diffracts sound waves. Direct sound waves 22 are sound waves that are unobstructed. Diffracted sound waves 21 are sound waves that are bent when they pass over the top of a partition 11. Refracted sound waves 23 are sound waves that are slightly diverted by the surface of the sound diffraction acoustic device 20. By changing the angle of the refracted sound waves 1 the acoustic "shadow" 24 becomes larger. The acoustic shadow 24 is an area with a sound pressure level that is about 10% of the initial sound source which may be below the threshold of human hearing. An acoustic shadow exists without the invention, however the angle of departure is much steeper, and the steeper departure angle normally puts the listener into the zone of refracted sound. By creating a higher angle of departure, the invention raises the acoustic shadow zone so the listener is in the shadow zone and the refracted sound zone is above the listener.

I claim:

1. A sound abatement acoustic device for use with an office partition comprising:

a hollow core;

a channel positioned on and secured to the core, the channel extending along the length of the hollow core, the channel defining an opening with opposed sidewalls that extends along the length of the core, the opening in the channel facing away from the core and being designed to be positioned on in an engaging relationship with an office partition whereby the device can be positioned on and secured to a partition;

a layer of sound absorbing material positioned on said core and around the channel except in the area of the opening in the channel; and a fabric material positioned over the layer of sound absorbing material to provide a finished appearance to the device.

2. The device of claim 1 wherein the channel has sidewalls that are resilient and are displaced to engage the partition, the sidewalls being biased towards the partition to secure the device to the partition.

3. The device of claim 1 wherein a first layer of sound absorbing material having a thickness from about ½" to about 1" and a density from about 2 to about 8 pounds per cubic foot is positioned on the hollow core.

4. The device of claim 3 wherein a center layer of sound absorbing material having a thickness from about ½" to about 1½" and a density from about 1 to about 4 pounds per cubic foot is positioned over the first layer of sound absorbing material.

5. The device of claim 4 wherein an outer layer of sound absorbing material having a thickness from about 1/16" to about ¼" and a density from about 2 to about 8 is positioned over the second layer of sound absorbing material.

6. The device of claim 1 wherein the fabric material is an acoustically transparent material.

7. The device of claim 1 wherein the hollow core has a diameter from about 6" to about 9".

* * * * *